US009530348B2

(12) United States Patent
Lee

(10) Patent No.: US 9,530,348 B2
(45) Date of Patent: Dec. 27, 2016

(54) ORGANIC LIGHT EMITTING DISPLAY DEVICE

(71) Applicant: Samsung Display Co., Ltd., Yongin (KR)

(72) Inventor: Seung-Kyu Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/202,926

(22) Filed: Mar. 10, 2014

(65) Prior Publication Data

US 2015/0015464 A1 Jan. 15, 2015

(30) Foreign Application Priority Data

Jul. 9, 2013 (KR) ..... 10-2013-0080268

(51) Int. Cl.
*G09G 5/00* (2006.01)
*G09G 3/32* (2016.01)

(52) U.S. Cl.
CPC .... *G09G 3/3233* (2013.01); *G09G 2300/0452* (2013.01); *G09G 2300/0842* (2013.01); *G09G 2320/0233* (2013.01)

(58) Field of Classification Search
USPC ..... 345/76, 55, 204, 212, 320, 690, 82, 77,345/694, 205, 88, 84, 214, 174
See application file for complete search history.

(56) References Cited

U.S. PATENT DOCUMENTS

2005/0062691 A1* 3/2005 Tamura et al. ..... 345/76
2005/0110723 A1* 5/2005 Shin ..... G09G 3/3233 345/76
2005/0259095 A1* 11/2005 Kwak ..... G09G 3/3233 345/204
2005/0280616 A1* 12/2005 Miwa ..... G09G 3/3233 345/77
2006/0125807 A1* 6/2006 Park ..... G09G 3/3233 345/204
2006/0154422 A1 7/2006 Chun et al.
2007/0080905 A1* 4/2007 Takahara ..... 345/76
(Continued)

FOREIGN PATENT DOCUMENTS

KR 10-2004-0027214 4/2004
KR 10-2006-0053746 5/2006

OTHER PUBLICATIONS

Wang et al., "A New Four-Transistor Poly-Si Pixel Circuit for AMOLED", IEEE Conference Publications, 2010, pp. 1453-1455.*

*Primary Examiner* — Thuy Pardo
(74) *Attorney, Agent, or Firm* — H.C. Park & Associates, PLC

(57) ABSTRACT

An organic light emitting display device including a pixel unit, a scan driver, a data driver and a timing controller. The pixel unit includes pixels positioned at intersection portions of scan lines and data lines, and an organic light emitting diode and a pixel circuit are formed in each pixel. The scan driver supplies a scan signal to the scan lines. The data driver supplies a data signal to the data lines. The timing controller supplies a scan control signal to the scan driver and supplies display data and a data control signal to the data driver. In the organic light emitting display device, each organic light emitting diode included in at least some of the pixels is driven by being coupled to a pixel circuit formed in an adjacent pixel.

12 Claims, 6 Drawing Sheets

(56) References Cited

U.S. PATENT DOCUMENTS

| | | | | |
|---|---|---|---|---|
| 2008/0068306 | A1* | 3/2008 | Miura | G09G 3/3233 345/77 |
| 2008/0180463 | A1* | 7/2008 | Ogura | 345/690 |
| 2008/0204368 | A1* | 8/2008 | Han et al. | 345/55 |
| 2009/0244055 | A1* | 10/2009 | Asano | G09G 3/3233 345/214 |
| 2009/0309863 | A1* | 12/2009 | Seto | 345/212 |
| 2011/0128262 | A1* | 6/2011 | Chaji | H01L 27/3211 345/205 |
| 2011/0273397 | A1* | 11/2011 | Hanari | G06F 3/0412 345/174 |
| 2012/0313923 | A1* | 12/2012 | Minami et al. | 345/212 |
| 2012/0327142 | A1* | 12/2012 | Kimura | 345/690 |
| 2013/0082912 | A1* | 4/2013 | Smith | H04N 13/0438 345/82 |
| 2013/0099700 | A1* | 4/2013 | Kreye et al. | 315/320 |
| 2013/0135183 | A1* | 5/2013 | Kimura et al. | 345/76 |
| 2013/0141469 | A1* | 6/2013 | Xu | G09G 3/3233 345/690 |
| 2013/0208032 | A1* | 8/2013 | Jang | G09G 3/3233 345/694 |
| 2013/0328951 | A1* | 12/2013 | Yamashita et al. | 345/690 |
| 2014/0104250 | A1* | 4/2014 | Nam et al. | 345/204 |

* cited by examiner

ORGANIC LIGHT EMITTING DISPLAY DEVICE

CROSS-REFERENCE TO RELATED APPLICATION

This application claims priority from and the benefit of Korean Patent Application No. 10-2013-0080268, filed on Jul. 9, 2013, which is hereby incorporated by reference for all purposes as if fully set forth herein.

BACKGROUND

Field

Exemplary embodiments of the present invention relate to an organic light emitting display device.

Discussion of the Background

Recently, various types of flat panel display devices have been developed which have a weight and volume that are much less than those of cathode ray tubes. The flat panel display devices include a liquid crystal display device, a field emission display device, a plasma display panel, an organic light emitting display device, and the like.

Among these flat panel display devices, the organic light emitting display device displays images using organic light emitting diodes that emit light through recombination of electrons and holes. The organic light emitting display device has a fast response speed and is driven with low power consumption. The organic light emitting display device has a plurality of pixels arranged in a matrix.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide an organic light emitting display device having improved image quality by preventing a line defect on a screen.

Additional features of the invention will be set forth in the description which follows, and in part will become apparent from the description, or may be learned from practice of the invention.

An exemplary embodiment of the present invention discloses an organic light emitting display device, including a plurality of pixels positioned at intersection portions of scan lines and data lines, wherein an organic light emitting diode and a pixel circuit are formed in each pixel; a scan driver configured to supply a scan signal to the scan lines; a data driver configured to supply a data signal to the data lines; and a timing controller configured to supply a scan control signal to the scan driver and supply display data and a data control signal to the data driver. Each organic light emitting diode included in at least some of the pixels is coupled to a pixel circuit formed in an adjacent pixel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1A:
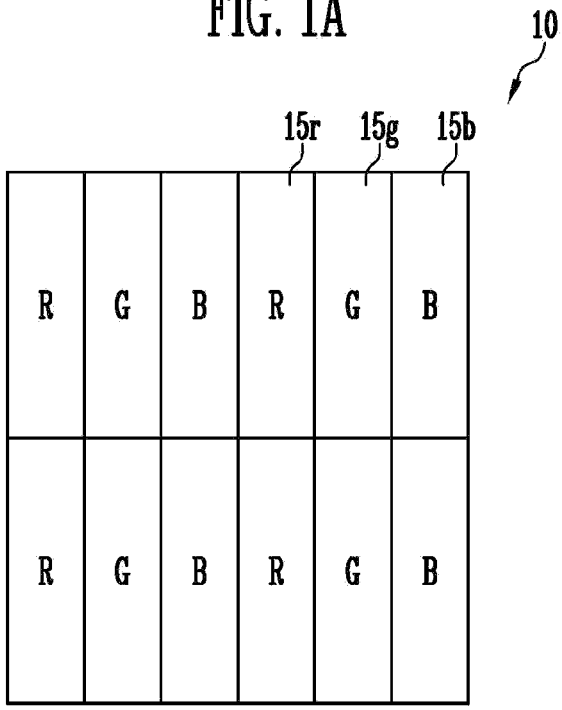
FIG. 1A is a diagram illustrating a conventional pixel arrangement structure.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of elements may be exaggerated for clarity. Like reference numerals in the drawings denote like elements.

It will be understood that when an element or layer is referred to as being "on"; "connected to"; or "coupled to" another element or layer, it can be directly on; directly connected to; or directly coupled to the other element or layer, or intervening elements or layers may be present. In contrast, when an element or layer is referred to as being "directly on"; "directly connected to"; or "directly coupled to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ). Further, some of the elements that are not essential to the complete understanding of the invention are omitted for clarity.

Figure 1B:
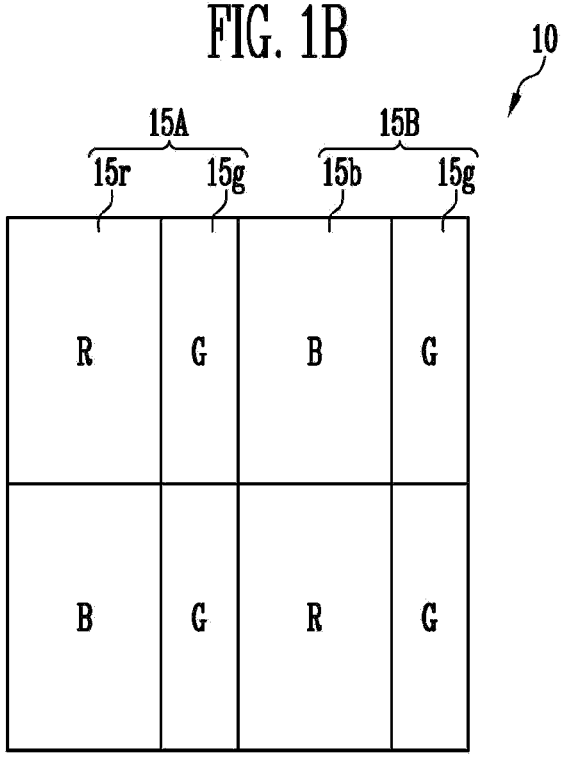
FIG. 1B is a diagram illustrating another conventional pixel arrangement structure.

FIG. 1A is a diagram illustrating an example of a conventional pixel arrangement structure. FIG. 1B is a diagram illustrating another example of a conventional pixel arrangement is structure. For convenience, only pixels which can be formed in a pattern will be shown in FIGS. 1A and 1B, and the pattern shown in FIGS. 1A and 1B may be repetitively arranged in a practical pixel unit.

Referring to FIGS. 1A and 1B, a plurality of pixels 15*r*, 15*g*, and 15*b* configured to emit light of different colors are arranged with regular patterns in a pixel unit 10 in order to display a color image.

For example, first pixels 15*r* configured to emit red light, second pixels 15*g* configured to emit green light, and third pixels 15*b* configured to emit blue light may be repetitively arranged with a regular pattern in the pixel unit 10.

As an example, the first, second, and third pixels 15*r*, 15*g*, and 15*b* may be arranged in a stripe pattern as shown in FIG. 1A. In this case, the first, second, and third pixels 15*r*, 15*g*, and 15*b* constitute sub-pixels of pixel units. One first pixel 15*r*, one second pixel 15*g*, and one third pixel 15*b* constitute each pixel unit, thereby expressing various colors.

As another example, the first, second, and third pixels 15*r*, 15*g* and 15*b* may be arranged in a Pen Tile pattern as shown in FIG. 1B. In this case, the second pixels 15*g* have a width narrower than that of each of the first and third pixels 15*r* and 15*b*. Thus, the second pixels 15*g* are respectively disposed between the first and third pixels 15*r* and 15*b*. The number of the second pixels 15*g* may be as many as the sum of the number of the first pixels 15*r* and the number of the third pixels 15*b*. That is, the number of the second pixels 15*g* may be twice the number of either the first or third pixels 15*r* or 15*b*.

In the pixel arrangement structure using the Pen Tile pattern, a pair of first and second pixels 15*r* and 15*g* disposed in parallel constitute a first sub-pixel 15A, and a pair of second and third pixels 15*g* and 15*b* disposed in parallel constitute a second sub -pixel 15B. In addition, adjacent first and second sub-pixels 15A and 15B constitute a pixel unit, thereby expressing different colors.

The pixel arrangement structure of the Pen Tile pattern can be usefully applied for the purpose of improving the lifespan of the organic light emitting display device in which characteristics of organic light emitting diodes are different for colors.

The first, second, and third pixels 15*r*, 15*g*, and 15*b* may be arranged in ways in the pixel unit 10, in addition to the stripe pattern or the Pen Tile pattern.

Figure 2:
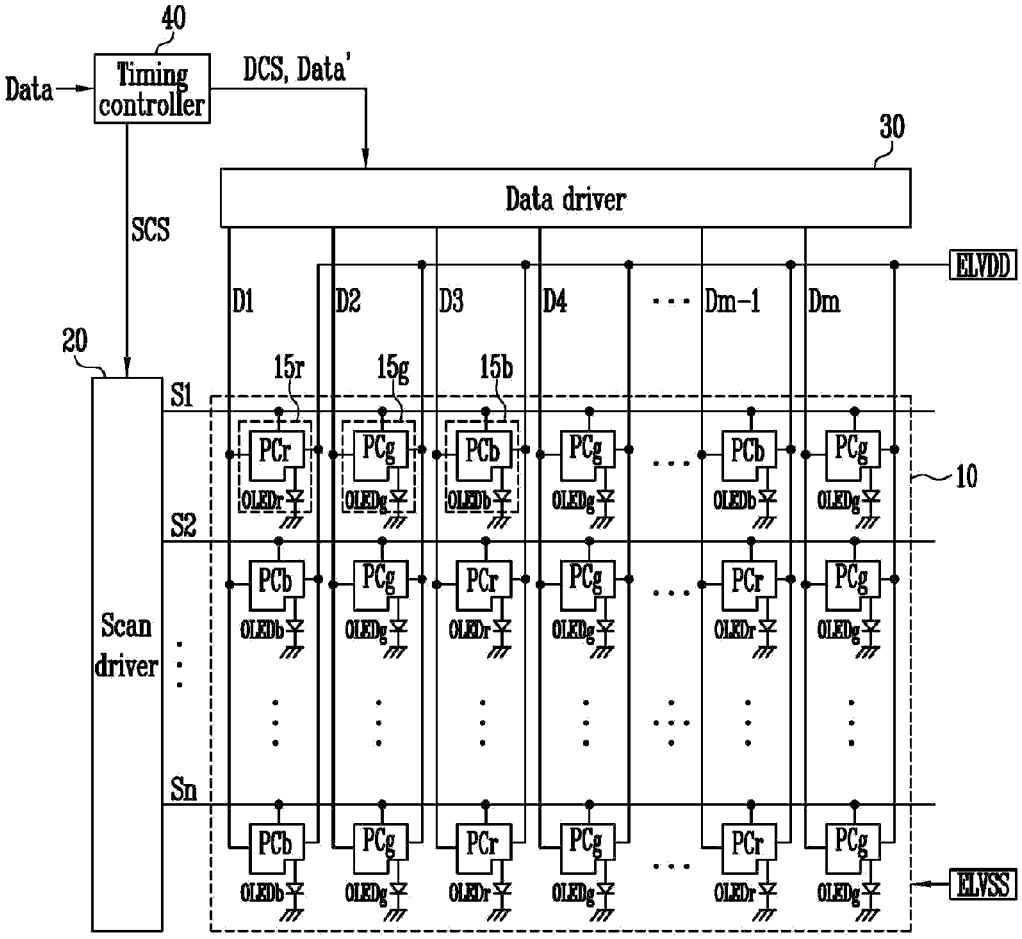
FIG. 2 is a diagram illustrating an organic light emitting display device according to an exemplary embodiment of the present invention.
Figure 3:
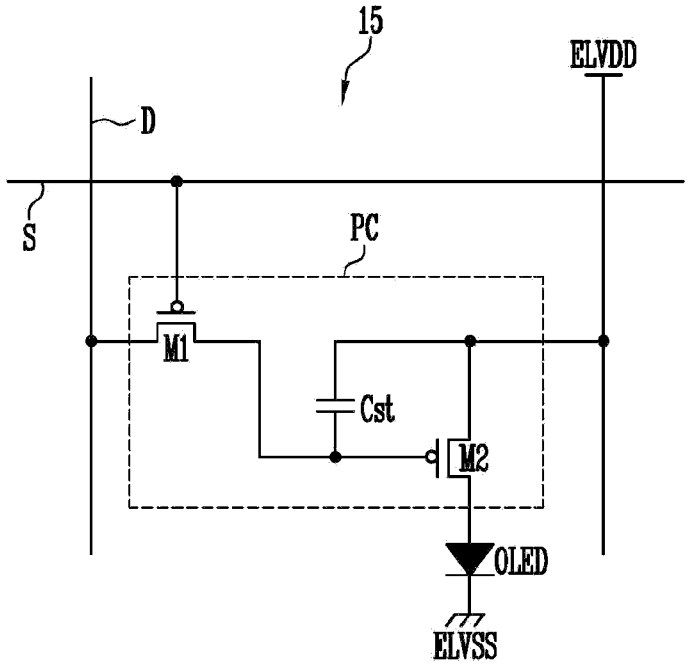
FIG. 3 is a circuit diagram illustrating an example of a pixel shown in FIG. 2.

FIG. 2 is a diagram illustrating an organic light emitting display device according to an exemplary embodiment of the present invention. FIG. 3 is a circuit diagram illustrating an example of a pixel shown in FIG. 2. For convenience, the pixel arrangement structure of the Pen Tile pattern shown in FIG. 1B is applied as an example in FIG. 2. However, the pixel arrangement structure applicable to the present invention is not limited to the Pen Tile pattern, and it will be apparent that the pixel arrangement structure may be variously modified.

First, referring to FIG. 2, the organic light emitting display device includes a pixel unit 10, a scan driver 20, a data driver 30, and a timing controller 40.

The pixel unit 10 is a main element that constitutes a panel of the organic light emitting display device. The pixel unit 10 includes a plurality of pixels 15*r*, 15*g*, and 15*b* positioned at intersection portions of scan lines S1 to Sn and data lines D1 to Dm. The pixel unit 10 receives scan lines S1 to Sn and data lines D1 to Dm respectively extending from the scan driver 20 and the data driver 30. In addition, the pixel unit 10 is connected to first and second pixel power sources ELVDD and ELVSS supplied from an external power circuit (not shown).

The pixels 15*r*, 15*g*, and 15*b* connected to the first and second pixel power sources ELVDD and ELVSS emit light with luminance corresponding to a data signal input when a scan signal is supplied.

In order to display a color image, the pixels 15*r*, 15*g*, and 15*b* may include first pixels 15*r* each including a first color organic light emitting diode OLED, e.g., a red organic light emitting diode OLEDr, second pixels 15*g* each including a second color organic light emitting diode, e.g., a green organic light emitting diode OLEDg, and third pixels 15*b* each including a third color organic light emitting diode, e.g., a blue organic light emitting diode OLEDb. That is, the first pixels 15*r* may be red pixels, the second pixels 15*g* may be green pixels, and the third pixels 15*b* may be blue pixels.

The first to third pixels 15*r*, 15*g*, and 15*b* may be arranged in the pixel unit 10 in a pixel arrangement structure having a preset rule in order to display a color image. For example, the first to third pixels 15*r*, 15*g*, and 15*b* may have a pixel arrangement structure according to a Pen Tile pattern.

In this case, the first pixels 15*r* and the third pixels 15*b* may be alternately disposed on some pixel columns, e.g., odd-numbered pixel columns, and the second pixels 15*g* may be disposed in a line on the other pixel columns, e.g., even-numbered pixel columns.

Meanwhile, in addition to the organic light emitting diodes OLEDr, OLEDg, and OLEDb configured to generate light, the pixels 15*r*, 15*g*, and 15*b* further include pixel circuits PCr, PCg, and PCb configured to control driving currents supplied to the organic light emitting diodes OLEDr, OLEDg, and OLEDb, respectively. That is, the organic light emitting diodes OLEDr, OLEDg, and OLEDb and the pixel circuits PCr, PCg, and PCb are respectively formed in the pixels 15*r*, 15*g*, and 15*b*.

The pixel circuit PC, as shown in FIG. 3, is configured to include a first transistor M1, a second transistor M2, and a storage capacitor Cst. In addition, the pixel circuit PC may further include one or more transistors and/or one or more capacitors. The structure of the pixel circuit PC may be variously modified.

The first, second, and third pixels 15*r*, 15*g*, and 15*b* may be designed to have the same structure. Thus, the first, second, and third pixels 15*r*, 15*g*, and 15*b* are each schematically shown as pixel 15 in FIG. 3.

Referring to FIG. 3, the pixel 15 includes an organic light emitting diode OLED and a pixel circuit PC configured to drive the organic light emitting diode OLED.

An anode electrode of the organic light emitting diode OLED is coupled to the pixel circuit PC, and a cathode electrode of the organic light emitting diode OLED is coupled to the second pixel power source ELVSS. When driving current is supplied from the pixel circuit PC, the organic light emitting diode OLED generates light with a luminance corresponding to the driving current.

The pixel circuit PC controls the amount of the driving current supplied to the organic light emitting diode OLED corresponding to a data signal supplied to a data line D when a scan signal is supplied to a scan line S.

The pixel circuit PC includes a first transistor M1, a second transistor M2, and a storage capacitor Cst. Here, the first transistor M1 is coupled between the data line D and one terminal of the storage capacitor Cst, and has a gate electrode coupled to the scan line S. The second transistor M2 is coupled between the first pixel power source ELVDD and the organic light emitting diode OLED, and has a gate electrode coupled to a coupling node between the first transistor M1 and the storage capacitor Cst. The storage capacitor Cst is coupled between a first electrode and the gate electrode of the second transistor M2.

The first transistor M1 is turned on when the scan signal is supplied to the scan line S, to supply the data signal supplied from the data line D to the storage capacitor Cst. Then, the storage capacitor Cst is charged with a voltage corresponding to the data signal and, accordingly, the voltage corresponding to the data signal is applied to the gate electrode of the second transistor M2. Then, the second transistor M2 supplies, to the organic light emitting diode OLED, a driving current corresponding to the data signal.

In a case where the data signal is a data signal corresponding to a black gray scale, the second transistor M2 is turned off to block the driving current from flowing through the organic light emitting diode OLED. In a case where the data signal is a data signal corresponding to a non-black gray scale, the second transistor M2 is turned on to an amount corresponding to the data signal, thereby forming a current path of driving current flowing from the first pixel power source ELVDD to the second pixel power source ELVSS via the second transistor M2 and the organic light emitting diode OLED. Accordingly, the organic light emitting diode OLED emits light with a luminance corresponding to the data signal.

As such, the pixel 15 includes the pixel circuit PC configured to include the plurality of transistors M1 and M2 and a storage capacitor Cst, and the organic light emitting diode OLED is driven to produce light corresponding to the driving current supplied from the pixel circuit PC.

Referring back to FIG. 2, the scan driver 20 generates a scan signal, corresponding to a scan control signal SCS supplied from the timing controller 40, and progressively supplies the generated scan signal to the scan lines S1 to Sn. If the scan signal is supplied to the scan lines S1 to Sn, the pixels 15*r*, 15*g* and 15*b* are progressively selected for each horizontal line.

The data driver 30 generates a data signal using a display data Data and a data control signal DCS supplied from the timing controller 40, and supplies the generated data signal to the data lines D1 to Dm whenever the scan signal is supplied. Then, the data signal is supplied to the pixels 15*r*, 15*g*, and 15*b* selected by the scan signal.

The timing controller 40 generates the scan control signal SCS and the data control signal DCS corresponding to externally-supplied synchronization signals. The scan control signal SCS generated by the timing controller 40 is supplied to the scan driver 20, and the data control signal DCS generated by the timing controller 40 is supplied to the data driver 30. The timing controller 40 supplies, to the data driver 30, the externally-supplied display data Data.

The organic light emitting display device described above is an active matrix type organic light emitting display device that includes organic light emitting diodes OLEDr, OLEDg, and OLEDb and pixel circuits PCr, PCg, and PCb in the respective pixels 15*r*, 15*g*, and 15*b*. The organic light emitting display device has an advantage in that the power consumption of the organic light emitting diode is small.

As shown in FIG. 3, the pixel circuit PC includes a plurality of transistors including the first and second transistors M1 and M2. The characteristics of the transistors M1 and M2 are closely related to emission luminance of the pixel 15.

Here, semiconductor layers of the transistors M1 and M2 may be crystallized using laser radiation, such as an excimer laser annealing (ELA). In this case, the panel using the pixel unit 10 as a main element may be crystallized by being divided into a plurality of areas, which results in a line defect at a boundary of each area. This will be described in detail below with reference to FIG. 4.

Figure 4:
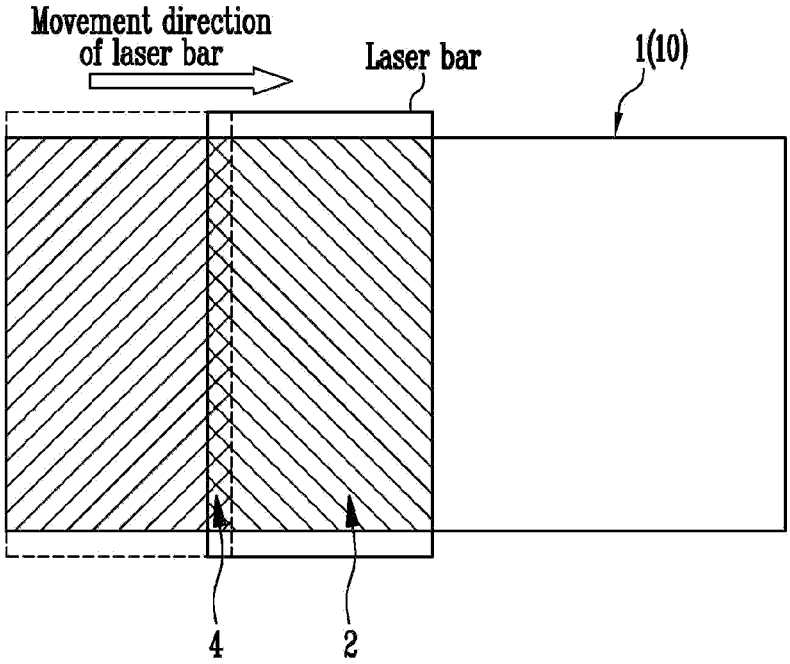
FIG. 4 is a diagram illustrating a crystallization process of a panel using a laser.

FIG. 4 is a diagram illustrating a crystallization process of a panel using laser radiation.

Referring to FIG. 4, the panel 1 including the pixel unit 10 as a main element may pass through the crystallization process by being divided into two or more areas.

More specifically, ELA crystallization equipment is manufactured to have a certain size, and therefore, the size of a laser bar with which the ELA crystallization equipment can radiate laser light has difficulty in covering all transistors formed in the panel 1.

For example, in order to crystallize the transistors formed in the large-size panel 1, the panel 1 is divided into areas 2, and laser light is radiated onto the divided areas 2.

In this case, a boundary portion 4 between the divided areas 2 generally passes through the crystallization process twice due to a margin error of the ELA crystallization equipment, etc. That is, in a case where the panel 1 is divided into a plurality of areas 2, and laser light is radiated onto each area 2, the boundary portion 4 between the divided area passes through the crystallization process (i.e., laser radiation) twice.

In this case, the characteristics of transistors positioned at the boundary portion 4 between the divided areas 2 is different from that of transistors positioned in the other area 2. Therefore, variations in characteristics of the pixels of the boundary portion 4 are relatively large, as compared to pixels in the other areas 2. This may cause a line defect on a screen, thereby lowering image quality.

Particularly, in a case where the second pixels having the organic light emitting diodes OLEDg are disposed in a line on preselected pixel columns as shown in FIG. 2, the line defect becomes significant, thereby lowering image quality.

Accordingly, a plan for improving image quality by preventing a line defect on a screen will be disclosed according to exemplary embodiments of the present invention. This will be described in detail below with reference to FIGS. 5 to 7.

Figure 5:
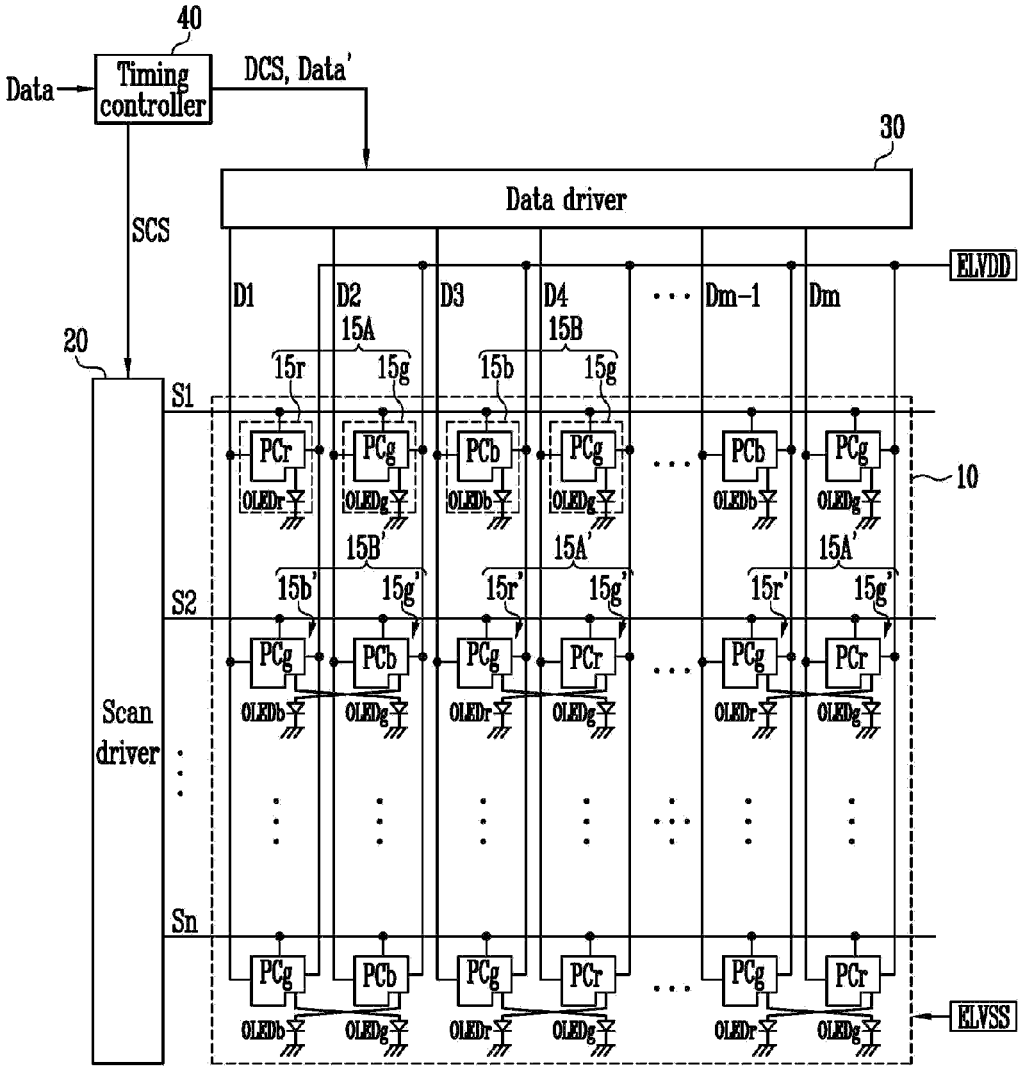
FIG. 5 is a diagram illustrating an organic light emitting display device according to another exemplary embodiment of the present invention.
Figure 6:
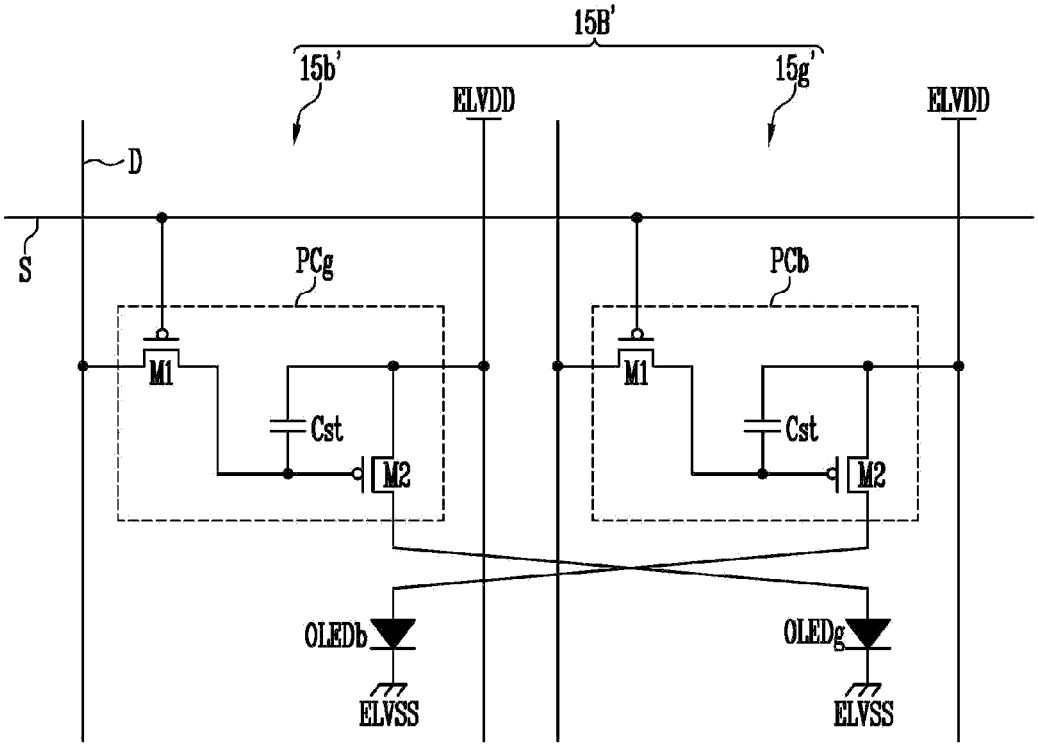
FIG. 6 is a circuit diagram illustrating a structure in which organic light emitting diodes and pixel circuits of two adjacent pixels are cross-coupled to each other in some of the pixels shown in FIG. 5.

FIG. 5 is a diagram illustrating an organic light emitting display device according to another exemplary embodiment of the present invention. FIG. 6 is a circuit diagram illustrating a structure in which organic light emitting diodes and pixel circuits of two adjacent pixels are cross-coupled to other in some of the pixels shown in FIG. 5. For convenience, in FIGS. 5 and 6, portions identical or similar to those of FIGS. 2 and 3 are designated by like reference numerals, and their detailed descriptions will be omitted.

Referring to FIGS. 5 and 6, in the organic light emitting display device according to this exemplary embodiment, organic light emitting diodes OLEDr, OLEDg, and OLEDb included in at least some pixels 15*r*', 15*g*', and 15*b*' are respectively coupled to pixel circuits PCr, PCg, and PCb formed in areas of adjacent pixels 15*r*', 15*g*', and 15*b*'.

In at least some pixels 15*r*', 15*g*', and 15*b*' provided in the pixel unit 10, organic light emitting diodes OLED and pixel circuits PC in two pixels, which are disposed in parallel to emit light of different colors, may be cross-coupled to each other.

According to the Pen Tile pattern in which a pair of adjacent first and second pixels 15*r* and 15*g* constitute a first sub-pixel 15A, and a pair of adjacent second and third pixels 15*g* and 15*b* constitute a second sub-pixel 15B, the organic light emitting diodes OLEDr, OLEDg, and OLEDb and the pixel circuits PCr, PCg, and PCb in the first and second pixels 15*r*' and 15*g*' or the second and third pixels 15*g*' and 15*b*' may be cross-coupled to each other in at least some of the sub-pixels 15A' and 15B'.

For example, the organic light emitting diodes OLEDr, OLEDg, and OLEDb and the pixel circuits PCr, PCg, and PCb in the first and second pixels 15*r*' and 15*g*' or the second and third pixels 15*g*' and 15*b*' may be cross-coupled to each other inside sub-pixels 15A' and 15B' positioned on an odd-numbered or even-numbered horizontal line for each horizontal line of the pixel unit 10.

That is, in the first sub-pixels 15A' among the sub-pixels 15A' and 15B', the first color organic light emitting diode OLEDr of the first pixel 15*r*' may be coupled to the pixel circuit PCr formed in the second pixel 15*g*' adjacent to the first pixel 15*r*', i.e., the second pixel 15*g*' having the second color organic light emitting diode OLEDg formed therein, and the second color organic light emitting diode OLEDg of the second pixel 15*g*' may be coupled to the pixel circuit PCg formed in the first pixel 15*r*' adjacent to the second pixel 15*g*', i.e., the first pixel 15*r*' having the first color organic light emitting diode OLEDr formed therein.

In this case, the pixel circuit PCg formed in the first pixel 15*r*' substantially becomes a pixel circuit PCg for driving the organic light emitting diode OLEDg of the second pixel 15*g*', and the pixel circuit PCr formed in the second pixel 15*g*' substantially becomes a pixel circuit PCr for driving the organic light emitting diode OLEDr of the first pixel 15*r*'.

In the second sub-pixels 15B', the second color organic light emitting diode OLEDg of the second pixel 15*g*' may be coupled to the pixel circuit PCg formed in the third pixel 15*b*' adjacent to the second pixel 15*g*', i.e., the third pixel 15*b*' having the third color organic light emitting diode OLEDb formed therein, and the third color organic light emitting diode OLEDb of the third pixel 15*b*' may be coupled to the pixel circuit PCb formed in the second pixel 15*g*' adjacent to the third pixel 15*b*', i.e., the second pixel 15*g*' having the second color organic light emitting diode OLEDg formed therein.

In this case, the pixel circuit PCb formed in the second pixel 15*g*' substantially becomes a pixel circuit PCb for driving the organic light emitting diode OLEDb of the third pixel 15*b*', and the pixel circuit PCg substantially becomes a pixel circuit PCg for driving the organic light emitting diode OLEDg of the second pixel 15*g*'.

That is, in the exemplary embodiment of the present invention, the second pixels 15*g* and 15*g*' emitting the same green light are disposed in a line on preselected pixel columns, e.g., even-numbered pixel columns, provided in the pixel unit 10. In this case, the organic light emitting diodes OLEDg included in at least some second pixels 15*g*' among the second pixels 15*g* and 15*g*' disposed on the preselected pixel columns are coupled to the pixel circuits PCg formed in the areas of the first or third pixels 15*r*' or 15*b*' on pixel columns adjacent to the preselected pixel columns.

For example, the second pixels 15*g* and 15*g*' disposed on the predselected pixel columns may be alternately coupled to the pixel circuits PCg formed in the areas of the first or third pixels 15*r*' and 15*b*' on pixel columns adjacent the preselected pixel columns.

Thus, in a case where laser light is radiated twice onto a pixel column on which the second pixels 15*g* and 15*g*' are arranged in the ELA crystallization process so that the characteristic of transistors M is different from that of transistors on other pixel columns, the non-uniformity of luminance caused by the variation is spread into the first or third pixels 15*r*' or 15*b*', so that it is possible to prevent the second pixels 15*g* and 15*g*' from exhibiting a line defect, etc.

In the exemplary embodiment of the present invention, it is possible to effectively prevent the reduction in image quality due to the line defect even when pixels of at least one color are disposed in a line along the same pixel column.

In the organic light emitting display device utilizing the exemplary embodiment of the present invention, although the pixel column onto which laser light is radiated twice in the ELA crystallization process is not necessarily a pixel column on which pixels emitting the same color are arranged, at least some of the organic light emitting diodes OLED disposed on the pixel column may be coupled to the pixels PC formed on the pixel column onto which laser light is radiated once. In this case, a variation in luminance is spread, so that it is possible to prevent the occurrence of a line defect. Accordingly, it is possible to improve image quality.

Thus, the exemplary embodiment of the present invention will be useful particularly when pixels emitting the same color are arranged on at least some pixel columns. However, the present invention is not limited thereto. That is, the present invention can be usefully applied to all organic light emitting display devices having various pixel arrangements.

In the exemplary embodiment of the present invention, the timing controller 40 provides the data driver 30 with externally-supplied display data Data. In this process, the display data Data may be rearranged corresponding to the positions of the pixel circuits PCr, PCg, and PCb coupled to the organic light emitting diodes OLEDr, OLEDg, and OLEDb of the respective pixels 15*r*, 15*r*', 15*g*, 15*g*', 15*b*, and 15*b*'. The rearranged display data Data' may be provided to the data driver 30.

For example, the timing controller 40 may be programmed so that addresses corresponding to the positions of the pixel circuits PCr, PCg, and PCb coupled to the respective organic light emitting diode OLEDr, OLEDg, and OLEDb. Accordingly, the organic light emitting display device of the exemplary embodiment of the present invention can be normally driven without any driving error.

Figure 7:
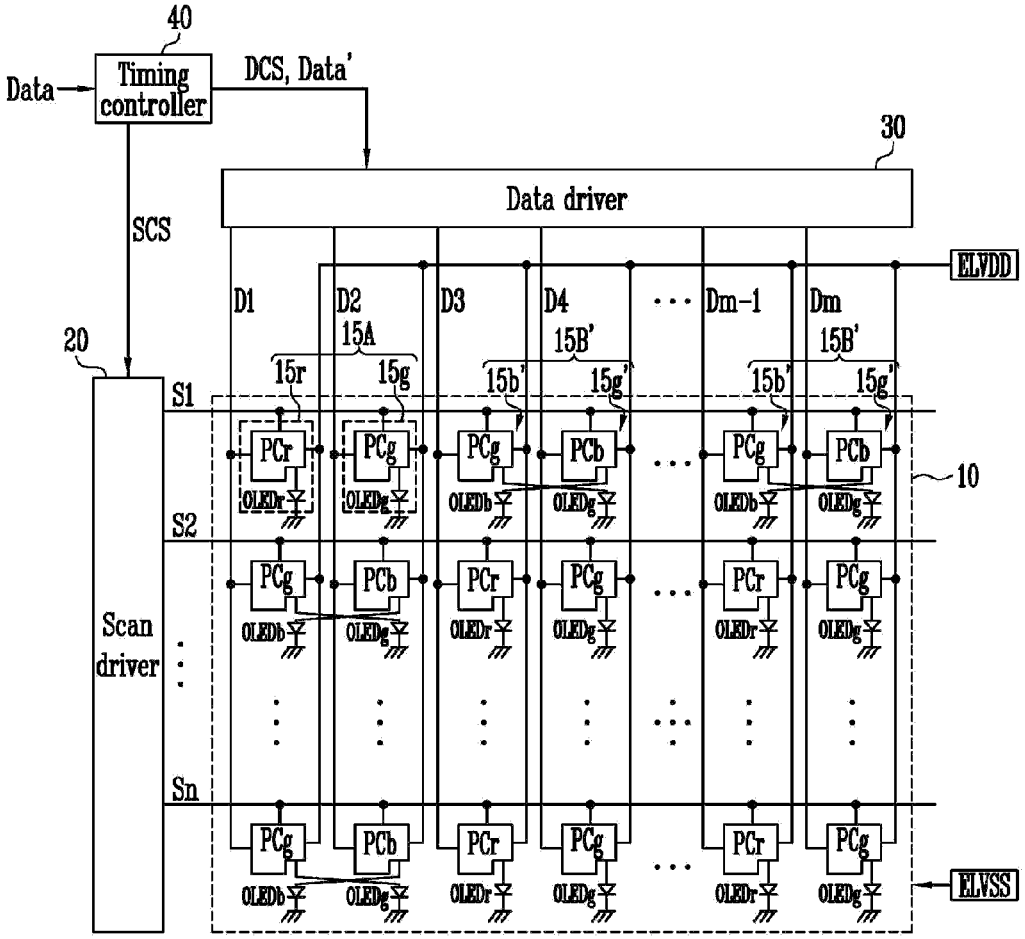
FIG. 7 is a diagram illustrating an organic light emitting display device according to still another exemplary embodiment of the present invention.

FIG. 7 is a diagram illustrating an organic light emitting display device according to still another exemplary embodiment of the present invention. For convenience, in FIG. 7, portions identical or similar to those of FIG. 5 are designated by like reference numerals, and their detailed descriptions will be omitted.

Referring to FIG. 7, the sub-pixels in which organic light emitting diodes OLED and pixel circuits of two pixels are cross-coupled to each other may be specified as first or second subs-pixels 15A or 15B'.

For example, in the first sub-pixels 15A, a first color organic light emitting diode OLEDr may be coupled to a pixel circuit PCr formed in a first pixel 15*r* in which the first color organic light emitting diode OLEDr is formed, and a second color organic light emitting diode OLEDg may also be coupled to a pixel circuit PCg formed in a second pixel 15*g* in which the second color organic light emitting diode OLEDg is formed.

On the other hand, in the second sub-pixels 15B', organic light emitting diodes OLEDg and OLEDb and pixel circuits PCg and PCb of second and third pixels 15*g*' and 15*b*' may be cross-coupled to each other.

In this case, the pixel unit 10 of the organic light emitting display device is formed in a checkerboard pattern using sub-pixels 15A and 15B' as a unit. In the pixel unit 10, some sub-pixels, e.g., the organic light emitting diodes OLEDg and OLEDb and the pixel circuits PCg and PCb of the second and third pixels 15*g*' and 15*b*' constituting the second sub-pixels 15B' are cross-coupled each other.

FIGS. 5 and 7 disclose exemplary embodiments of the present invention, and the present invention is not necessarily limited thereto. That is, adjacent pixels driven so that their organic light emitting diodes and pixel circuits are coupled to cross each other may be selected in various manners.

The organic light emitting display device of the Pen Tile pattern has been disclosed in various illustrated exemplary embodiments of the present invention. In one exemplary embodiment, organic light emitting diodes OLED and pixel circuits of two pixels included in some sub-pixels among the sub-pixels of the Pen Tile pattern are cross-coupled to each other. However, the present invention is not limited thereto. That is, the pixels in which the organic light emitting diodes OLED and the pixel circuits PC are cross-coupled to each other are not necessarily included in the same sub-pixel or pixel unit, and may be variously modified.

By way of summation and review, pixels display a preselected image while controlling driving current supplied to organic light emitting diodes, corresponding to a data signal. To this end, each pixel includes an organic light emitting diode and a pixel circuit configured to control driving current flowing through the organic light emitting diode. The pixel circuit includes a plurality of transistors including a driving transistor.

Each transistor provided in the pixel circuit includes a semiconductor layer having source, drain, and channel regions, a gate electrode, a source electrode, and a drain electrode. The semiconductor layer is formed of polycrystalline silicon or amorphous silicon. In this case, polycrystalline silicon having high electron mobility is currently used for the semiconductor layer in most organic light emitting display devices.

The polycrystalline silicon is prepared by forming amorphous silicon on a substrate and then crystallizing the amorphous silicon formed on the substrate. In this case, various methods for crystallizing the amorphous silicon may be used, but a method for radiating laser light onto the amorphous silicon to be crystallized into the polycrystalline silicon, such as ELA, are currently used in most processes.

Here, the methods for radiating laser light onto the amorphous silicon to be crystallized into the polycrystalline silicon have great influence on characteristics of transistors, such as mobility and threshold voltage. However, the ELA crystallization equipment is manufactured to certain size constraints, and hence there occurs a case where a panel is divided into areas, and laser light is radiated onto the divided areas.

In this case, the characteristic of transistors positioned at a boundary portion between the divided areas may be different from that of transistors positioned in the other areas with a relatively large variation. Accordingly, a line defect occurs at the boundary portion on a screen, thereby lowering image quality.

As described above, according to exemplary embodiments of the present invention, each organic light emitting diode included in at least some pixels among the plurality of pixels arranged in the pixel unit is coupled to a pixel circuit in the area of an adjacent pixel, so that it is possible to prevent a line defect on a screen and to improve image quality.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display device, comprising:

pixels disposed between intersecting scan lines and data lines, each pixel comprising an organic light emitting diode and a pixel circuit;

a scan driver configured to supply a scan signal to the scan lines;

a data driver configured to supply a data signal to the data lines; and a timing controller configured to supply a scan control signal to the scan driver and to supply display data and a data control signal to the data driver, wherein:

one of two adjacent pixels connected to a same scan line comprises a first pixel circuit and a first organic light emitting diode;

the other pixel comprises a second pixel circuit and a second organic light emitting diode;

the first pixel circuit is connected to the second organic light emitting diode; and the second pixel circuit is connected to the first organic light emitting diode.

2. The organic light emitting display device of claim 1, wherein the organic light emitting diodes and pixel circuits of at least some of the pixels that are disposed in parallel with each other and that emit light of different colors, are cross-coupled to each other.

3. The organic light emitting display device of claim 1, wherein:

pixels emitting light of the same color are disposed in a line on a pixel column of the pixels; and the organic light emitting diodes of at least some of the pixels disposed on the pixel column are coupled to pixel circuits of pixels in an adjacent pixel column.

4. The organic light emitting display device of claim 3, wherein the pixels disposed on the pixel column are alternately coupled to pixel circuits of pixels in an adjacent pixel column.

5. The organic light emitting display device of claim 1, wherein:

the timing controller is configured to receive the display data supplied from the outside of the organic light emitting display panel; and the timing controller is configured to rearrange the display data to correspond to the positions of the pixel circuits coupled to the organic light emitting diodes of each pixel, and to supply the rearranged display data to the data driver.

6. The organic light emitting display device of claim 1, wherein:

the pixels comprise first pixels each comprising a first color organic light emitting diode, second pixels each comprising a second color organic light emitting diode, and third pixels each comprising a third color organic light emitting diode; and each second color organic light emitting diode of at least some of the second pixels is coupled to a pixel circuit of an adjacent first or third pixel.

7. The organic light emitting display device of claim 6, wherein the second pixels are arranged along the same pixel column.

8. The organic light emitting display device of claim 6, wherein the first or third color organic light emitting diode of the adjacent first or third pixel is coupled to the pixel circuit of the pixel including the second color organic light emitting diode is formed.

9. The organic light emitting display device of claim 6, wherein:

the first, second and third pixels are arranged according to a Pen Tile pattern;

the first and third pixels are red or blue pixels; and the second pixels are green pixels.

10. The organic light emitting display device of claim 9, wherein:

a pair of adjacent first and second pixels or a pair of adjacent second and third pixels constitute a sub-pixel; and in sub-pixels positioned on an odd-numbered or even-numbered horizontal line for each horizontal line of the pixels, the organic light emitting diodes and the pixel circuits of the first and second pixels or the second and third pixels are cross-coupled to each other.

11. The organic light emitting display device of claim 9, wherein:

a pair of adjacent first and second pixels or a pair of adjacent second and third pixels constitute a sub-pixel; and in some sub-pixels formed in a checkerboard pattern using the sub-pixel as a unit, the organic light emitting diodes and the pixel circuits of the first and second pixels or the second and third pixels are cross-coupled to each other.

12. An organic light emitting display device, comprising:

pixels disposed at intersection points of scan lines and data lines, an organic light emitting diode and a pixel circuit being formed in each pixel;

a scan driver configured to supply a scan signal to the scan lines;

a data driver configured to supply a data signal to the data lines; and a timing controller configured to supply a scan control signal to the scan driver and to supply display data and a data control signal to the data driver, wherein:

one of two adjacent pixels connected to a same scan line comprises a first pixel circuit and a first organic light emitting diode;

the other pixel comprises a second pixel circuit and a second organic light emitting diode;

the first pixel circuit is connected to the second organic light emitting diode; and the second pixel circuit is connected to the first organic light emitting diode.

* * * * *